United States Patent [19]

Sakamaki et al.

[11] Patent Number: 5,033,946

[45] Date of Patent: Jul. 23, 1991

[54] ROTARY VANE MACHINE WITH BACK PRESSURE REGULATION ON VANES

[75] Inventors: Hiroshi Sakamaki; Yukio Horikoshi; Kenji Tanzawa, all of Sakado, Japan

[73] Assignee: Eagle Industry Co., Ltd., Tokyo, Japan

[21] Appl. No.: 394,773

[22] Filed: Aug. 16, 1989

Related U.S. Application Data

[60] Division of Ser. No. 197,548, May 23, 1988, Pat. No. 4,958,995, which is a continuation-in-part of Ser. No. 75,006, Jul. 17, 1987, abandoned, and a continuation-in-part of Ser. No. 110,919, Oct. 21, 1987, abandoned, and Ser. No. 113,568, Oct. 26, 1987, abandoned, and Ser. No. 115,677, Oct. 30, 1987, abandoned.

[30] Foreign Application Priority Data

| | | | |
|---|---|---|---|
| Jul. 22, 1986 | [JP] | Japan | 61-111490[U] |
| Jul. 22, 1986 | [JP] | Japan | 61-170903 |
| Oct. 23, 1986 | [JP] | Japan | 61-161609[U] |
| Oct. 23, 1986 | [JP] | Japan | 61-161610[U] |
| Nov. 4, 1986 | [JP] | Japan | 61-168145 |
| Nov. 4, 1986 | [JP] | Japan | 61-168147 |
| Nov. 14, 1986 | [JP] | Japan | 61-269960[U] |
| Nov. 14, 1986 | [JP] | Japan | 61-269961 |
| Nov. 17, 1986 | [JP] | Japan | 61-271934 |
| Nov. 21, 1986 | [JP] | Japan | 61-178287 |
| Nov. 21, 1986 | [JP] | Japan | 61-178288 |
| Nov. 21, 1986 | [JP] | Japan | 61-276689 |
| Nov. 21, 1986 | [JP] | Japan | 61-276690 |
| Dec. 3, 1986 | [JP] | Japan | 61-185571[U] |

[51] Int. Cl.[5] ..... F01C 1/344

[52] U.S. Cl. ..... 418/81; 418/82; 418/223; 418/257; 418/265; 418/268; 418/269

[58] Field of Search ..... 418/81, 82, 223, 257, 418/265, 268, 269

[56] References Cited

U.S. PATENT DOCUMENTS

| | | | |
|---|---|---|---|
| 1,580,713 | 4/1926 | Ensign | 418/81 |
| 1,669,779 | 5/1928 | Reavell | 418/265 |
| 3,306,224 | 2/1967 | Roberts | 418/82 |

*Primary Examiner*—John J. Vrablik

*Attorney, Agent, or Firm*—Jordan and Hamburg

[57] ABSTRACT

A rotary machine includes a stationary housing having a rotor chamber and a rotor rotatably mounted in the rotor chamber, the inner peripheral surface of the rotor chamber having a central axis which is eccentrically disposed relative to the axis of rotation of the rotor. The housing has generally planar inner end walls having a cylindrical opening through which the rotor shaft extends. A plurality of vanes are slidably mounted in vane slots in the rotor and operable to define variable volume chambers as the rotor rotates and the vanes move generally radially in and out of the vane slots. Back pressure regulating grooves are disposed in the end walls of the housing, the grooves having a central axis coincident with the axis of rotation of the rotor, the grooves being juxtaposed to the vane slots and communicating with the vane slots for regulating the internal back pressure on the vanes in the vane slots.

7 Claims, 7 Drawing Sheets

ROTARY VANE MACHINE WITH BACK PRESSURE REGULATION ON VANES

RELATED APPLICATIONS

This is a division is a Continuation-in-part- application of U.S. Ser. No. 075,006 filed July 17, 1987,abandoned; U.S. Ser. No. 110,919 filed Oct. 21, 1987, abandoned; U.S. Ser. No. 113,568 filed Oct. 26, 1987; and U.S. Ser. No. 115,677 filed Oct. 30, 1987, abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 11 has been heretofore widely known.

In FIG. 11, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* eqally spaced apart so as to peripherally divide the outer PeriPheral side of the rotor 102 into three sections. When the rotor 102 is rotated in tbe direction as indicated by the arrow X by the rotational shaft 103, the vanes 105*a*, 105*b* and 105*c* are moved out in rhe direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet Port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn: and the vanes are expanded due to the generation of sliding heat to produce a galling with the inner side surfaces of both end walls of the housing, and the like.

In view of these problems as noted above, it is a object of the present invention to enhance the efficiency of such a pump and enhance the durability thereof.

SUMMARY OF THE INVENTION

According to the present invention, a vane pump comprises a rotor rotatably supported in eccentric fashion in an inner peripheral space of a housing, and plate-like vanes disposed capable of being projected and retracted into a plurality of vane grooves in the form of depressions in the rotor, wherein repeated variations in volumes of working spaced between the vanes resulting from rotations of the rotor and the vanes are utilized to suck a fluid from one side and discharge it toward the other, characterized in that retainers or bearings coaxial with the inner peripheral spaces are rotatably disposed internally of the end wall of the housing, and the retainers or bearings are engaged with the vanes to define the protrusion of the vanes from the vane grooves, and a back pressure regulating groove is guided to a bottom of the vane groove positioned in the back surface of each of the vanes.

According to the present invention, the protrusion of the vanes from the vane grooves is not defined by the contact thereof with the inner peripheral surface of the housing but is defined so that the end edge of the vanes depicts a fixed locus by the engagement of the retainer fitted in the housing and each of the vanes. Therefore, the vanes may be rotated in the state where they are not in contact with the inner surface of the housing; and when the vanes are operated to be projected and retracted, pressure of the bottom of the vane groove positioned in the back surface of the vane is made adJustable so as not to apply an excessive load to the vanes being projected and retracted.

Thereby, the vane pump according to the present invention is designed so that the vanes may be rotated in a state not in contact with the inner peripheral surface of the housing, and therefore, the lowering of the rotational efficiency and the wear of vanes resulting from the sliding resistance may be prevented, and the occurrence of the lowering of the volumetric efficiency due to the increase of heat generation caused by sliding may be prevented; and the back pressure regulating groove is formed relative to the vane groove bottom so that the back pressure of the groove bottom may be regulated, and therefore the vanes may be operated smoothly without applying an excessive load thereto, and the smooth operation of the whole pump may be secured.

While the present invention has been briefly outlined, the above and other objects and new features of the present invention will be fully understood from the reading of the ensuing detailed description in conjunctio with embodiments shown in the accompanying drawings. It is t be noted that the drawings are exclusively used to show certain embodiments for the understanding of the present invention and are not intended to limit the scope of this invention.

DESCRIPTION OF THE PREFERRED EMBODIMENTS

Figure 1:
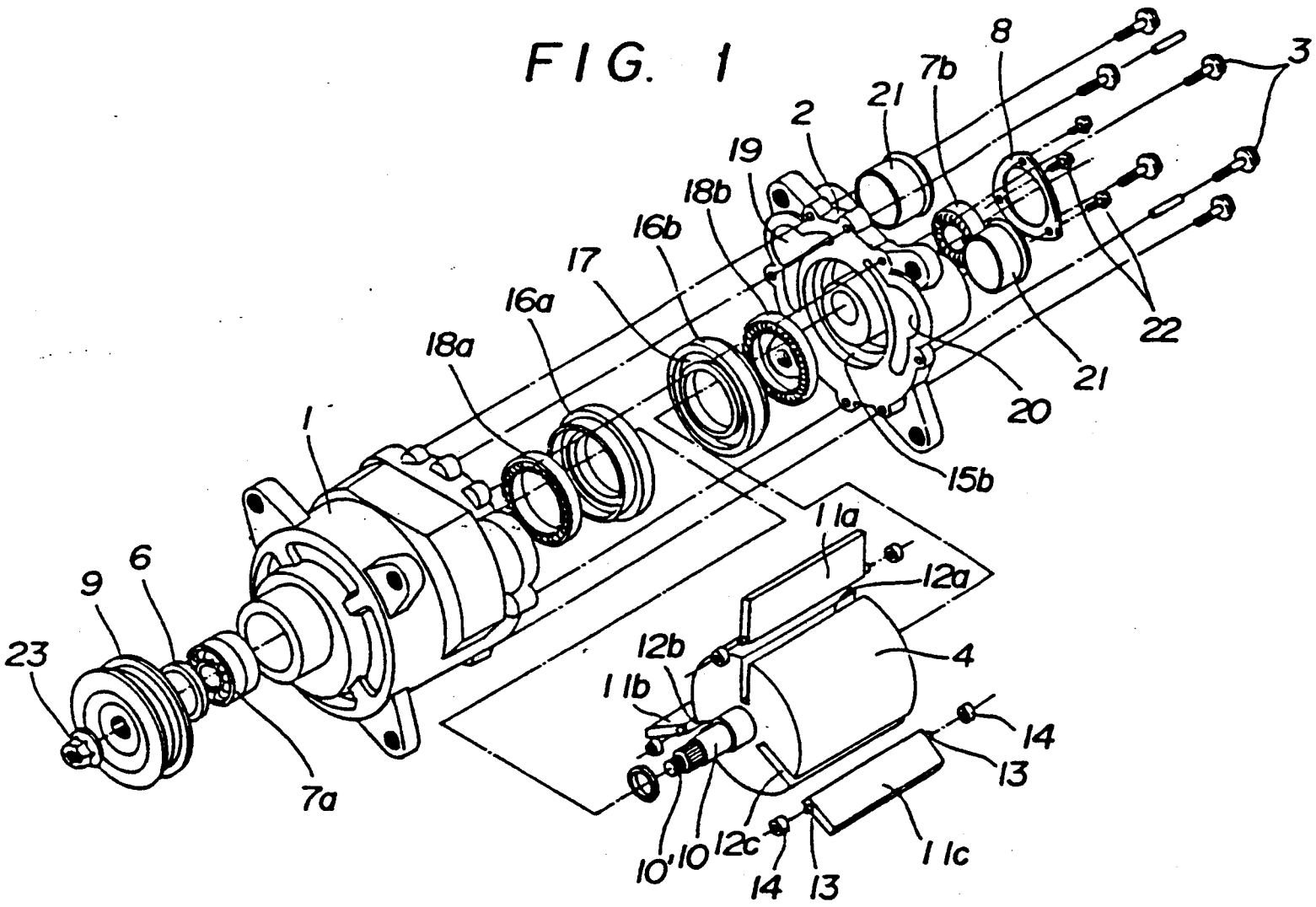
FIG. 1 is an exploded perspective view of a vane pump according to a fundamental embodiment of the present invention.
Figure 2:
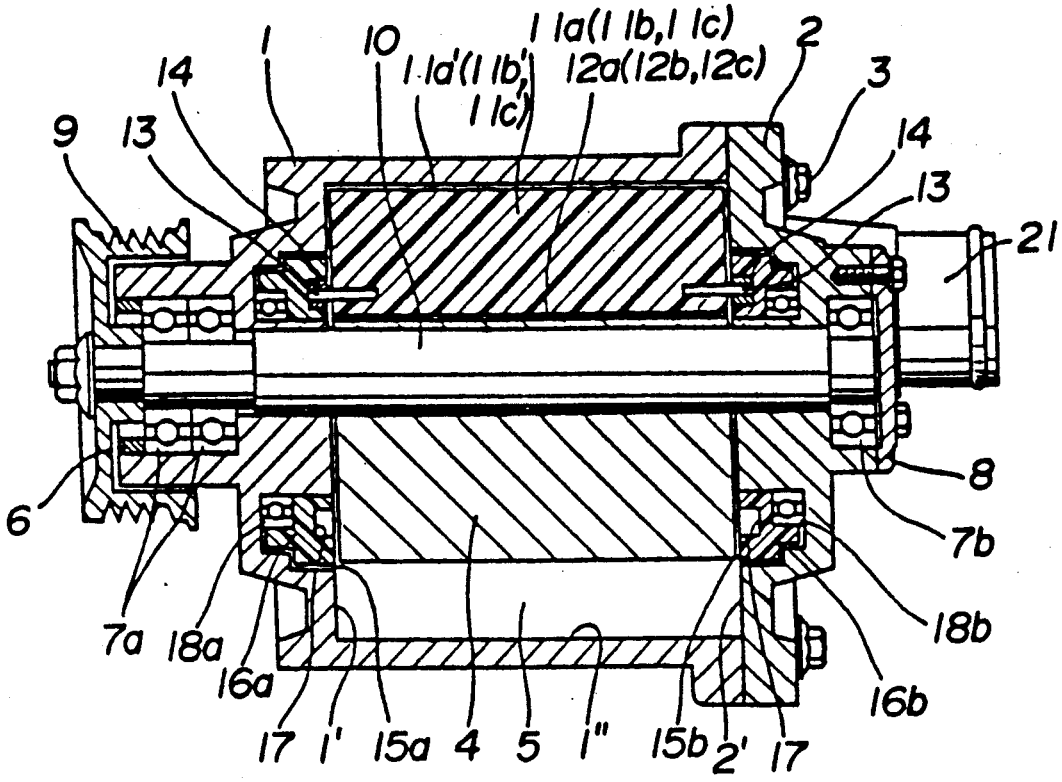
FIG. 2 is a sectional view showing the pump of FIG. 1 assembled.
Figure 3:
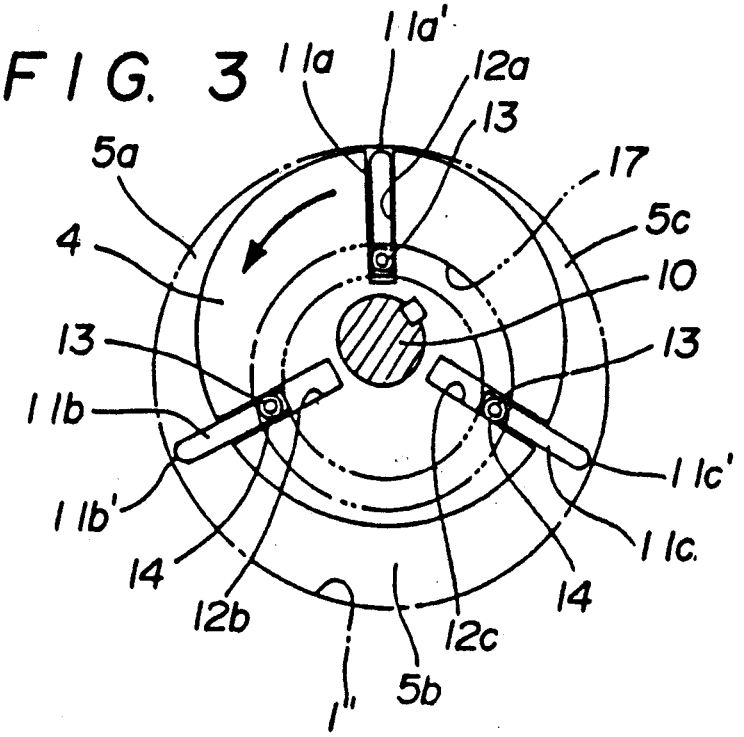
FIG. 3 is a side view of a rotor of the same pump of FIG. 1.

A fundamental exemplification of a vane pump according to the present invention will now be described with reference to FIGS. 1 to 3. In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing 14 made of resin having excellent slidability and abrasion resistance is slipped over each of pins 13. In annular recesses 15a and 15b formed in inner surfaces 1' and 240 of end walls where the front housing 1 and the rear housing 2 are opposed to each other coaxial with the inner peripheral space 5 of the housing (coaxial with the inner peripheral surface 1" of the front housing 1), retainer rings 16*a* and 16*b* made of non-ferrous metal such as aluminum and each having an annular race 17 are rotatably fitted through ball bearings 18*a* and 18*b*, respectively. The pins 13 and 13 projected on the respective vanes 11*a*, 11*b* and 11*c* peripherally slidably engage the annular races 17 and 17 of the retainer rings 16*a* and 16*b* through the respective sleeve bearings 14. This engagement defines the radial movement of the vanes 11*a*, 11*b* and 11*c* during rotation so as to maintain a state in which there is formed a slight clearance between the end edges 11*a*', 11*b*'and 11*c*40 (see FIG. 3) thereof and the inner peripheral surface 1" of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 1040 of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c* , respectively, and tbe sleeve bearings 14 and 14 slipped over the pins 13 and 13 rotate along the annular races 17 and 17. Since as shown in FIG. 3, the inner peripheral surface 1" of the housing and the annular race 17 are in coaxial relation and the annular race 17 and the rotor 4 are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 3, the working space 5*a*, with the rotation, increases its volume to suck the fluid from the intake port 19 (not shown; see FIG. 1) opening to portion 5*a*; the working space 5*c*, with the rotation, decreases its volume to discharge the fluid into the outlet port 20 (not shown; see FIG. 1) opening to portion 5*c*; and the working space 5*b* transfers the thus sucked fluid toward the outlet port 20. In the above-described operation, the end edges 11*a*40 , 11*b*40 and 11*c*40 of the vanes 11*a*, 11*b* and 11*c* are not in sliding contact with the inner peripheral surface 1" of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16*a* and 16*b* while the retainer rings 16*a* and 16*b* follow the sleeve bearing 14 for rotation because the former are in the state to be rotatable by the ball bearings 18*a* and 18*b*, respectively. The relative sliding speed between the sleeve bearing 14 and the annular race 17 is low whereby the abrasions of annular race 17, retainer rings 16*a* and 16*b* , the sleeve bearing 14 and the like can be minimized.

It is believed that the fundamental mode of the present invention is now fully understood from the above-described description. The pump of the first embodiment shown in FIGS. 1 and 3 constitutes, in a sense, the core of the variations described below.

Figure 4:
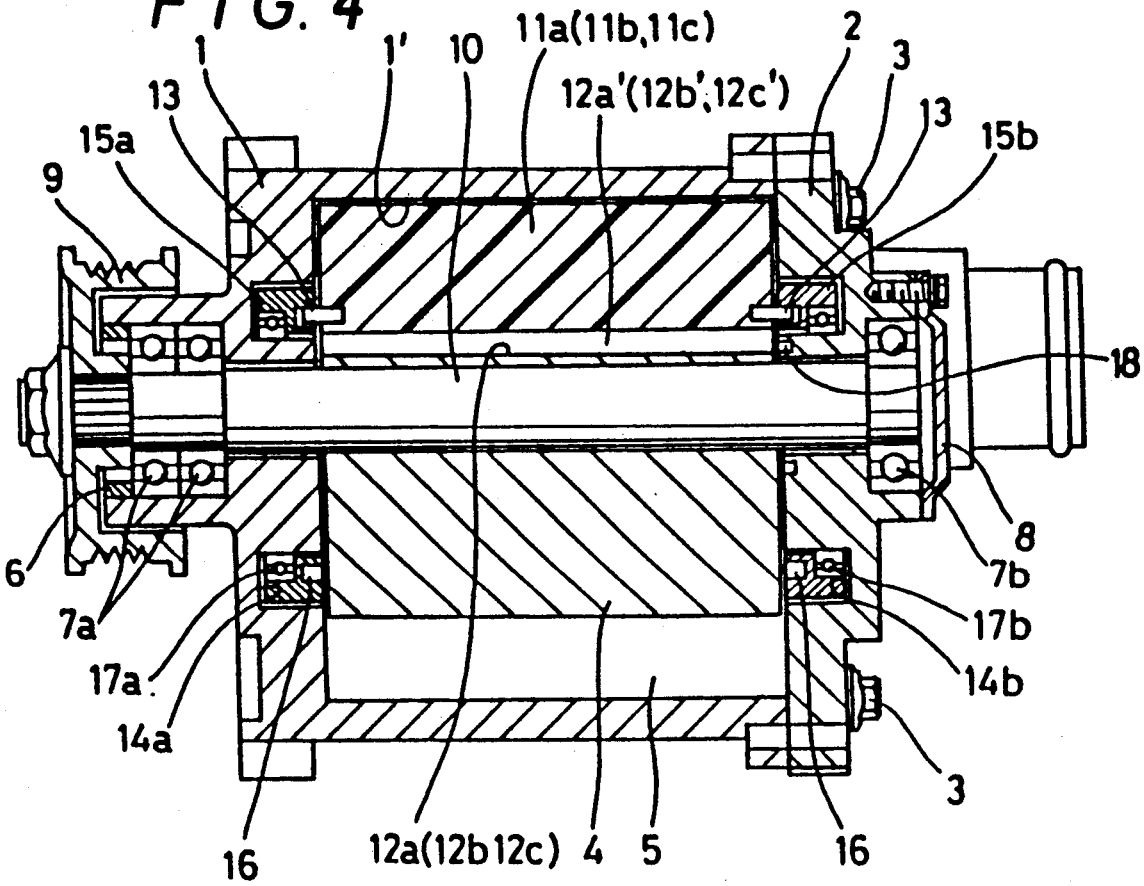
FIG. 4 is a sectional view of a vane pump according to another exemplification of the present invention.
Figure 5:
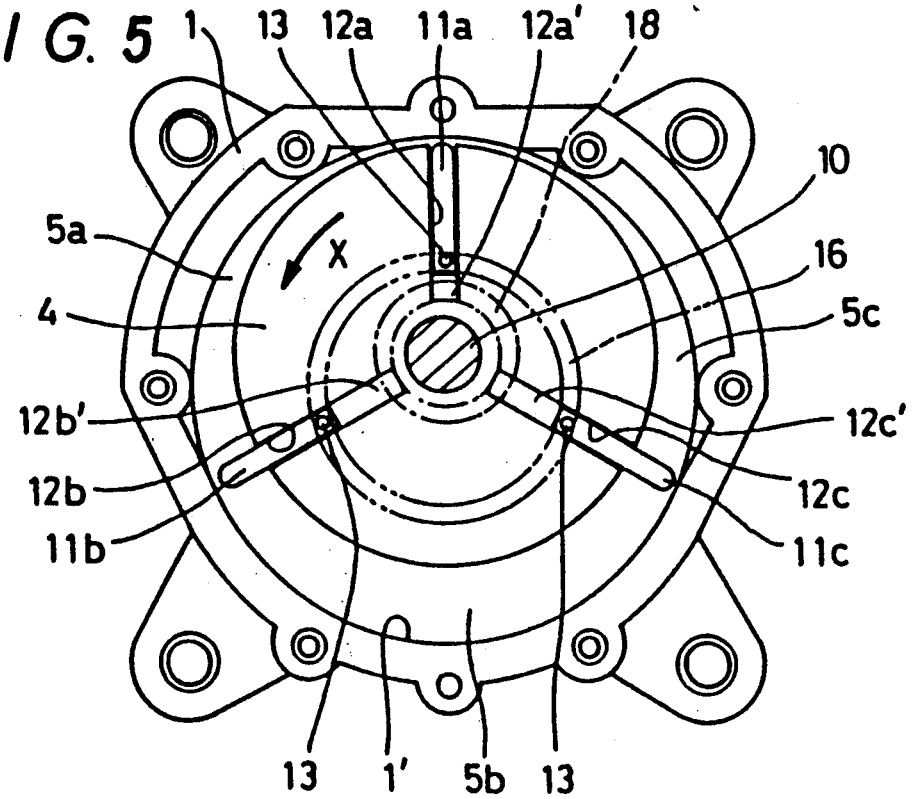
FIG. 5 is an explanatory view of the operation of the FIG. 4 embodiment.

An embodiment of a vane pump according to the present invention will be described hereinafter with reference to the embodiments shown in FIGS. 4 to 10.

in FIGS. 4 and 5, a front housing 1 and a rear housing 2, which both housings are made of non-ferrous metal such as aluminum which is light in weight and is small in coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in an anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which =formed in the form of depressions equally spaced apart so as to peripherally divide the outer peripheral side of the rotor 4 into three sections, on the rotor 4. On opposite ends of each of the vanes 11*a*, 11b and 11*c* corresponding to axial opposite sides of the rotor 4 are projected steel pins 13 and 13, respectively, and a sleeve bearing made of resin having excellent slidability and abrasion resistance is slipped over each of pins 13. Rotatably fitted in annular recesses 14*a* and 14*a* formed in inner surfaces of end walls where the front housing 1 and the rear housing 2 are opposed to each other coaxial with the inner peripheral space 5 of the housing coaxial with an inner peripheral surface 140 of the front housing 1 are retainer plates 15*a* and 15*b* made of non-ferrous metal such as aluminum and each having an annular race 16. The pins 13 and 13 projected on the respective vanes 11*a*, 11*b* and 11*c* peripherally slidably engage rhe annular races 16 and 16 of the retainer plates 15*a* and 15*b*. This engagement defines the radial movement of the vanes 11*a*, 11*b* and 11*c* during rotation so as to maintain a state in which there is formed a slight clearance between the end edges thereof and the inner peripheral surface 140 of the front housing 1. In the inner surface of the end wall of the rear housing 2, an annular back pressure regulating groove 18 is formed coaxially with the rotational shaft 10 on the inside diameter side of the annular recess 14*b* so that bottoms 12*a*40 , 12*b*40 and 12*c*40 of vane grooves 12*a*, 12*b* and 12*c*, respectively, positioned in the back surface (inner end side) of the vanes 11*a*, 11*b* and 11*c* communicate with one another as shown in FIG. 5.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c*, respectively, rotate along the annular races 17 and 17. Since as shown in FIG. 5, the inner peripheral surface 140 of the housing and the annular race 16 are in coaxial relation and the annular race 16 and the rotor are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 5, the working space 5*a*, with the rotation, increases its volume to suck the fluid from the intake port opening to portion 5*a*; the working space 5*c*, with the rotation, decreases its voIume to discharge the fluid into the outlet port opening to portion 5*c*; and the workingspace 5*b* transfers the thus sucked fluid toward the outlet port. In the above-described operation, the end edges of the vanes 11*a*, 11*b* and 11*c* are not in sliding contact with the inner peripheral surface 140 of the front housing, as previously mentioned, and therefore, abrasion or high heat hardly occurs. The pins 13 are slidably rotared while being pressed against the outside diameter side by the centrifugal force within the annular race 16 of rhe retainer plates 15*a* and 15*b* but the retainer plates 15*a* and 15*b* follow the pins 13 and rotate since the retainer plates are in the state in which they may be rotated by the presence of the ball bearings 17*a* and 17*b*. The relative sliding speed between the pins 13 and the annular races 16 is small thereby minimizing the abrasions of the annular races (retainer plates 15*a*, 15*b*), pins 13, etc.

In the aforementioned operation, paying attention to the bottoms 12*a*40 , 12*b*40 and 12*c*40 of the vane grooves 12*a*, 12*b* and 12*c*, the volumes of the bottoms 12*a*40 , 12*b*40 and 12*c*40 are repeatedly increased and decreased by the projection and retraction of the vanes 11*a*, 11*b* and 11*c* caused by the rotation of the rotor 4, which is the minimun at the top position in which the vane 11*a* is in its most retracted state as shown in FIG. 5, whereas it is at the maximum at the bottom position in which the vane is in the most protruded state. The internal pressure of the bottoms 12*a*40 , 12*b*40 and 12*c*40 acting as back pressure on the vanes 11*a*, 11*b* and 11*c* increases and decreases according to the aforesaid volumes to induce the state wherein a serious load is applied to the pin 13 in engagement with tbe annular race 16. More specifically, in FIG. 5, the vane groove bottom 12*b*40 is in the process in which the volume thereof increases, and the internal pressure of the bottom 12*b*40 gradually decreases. The vane groove bottom 12*c*40 which is in the posirion beyond the bottom position is conversely in the process in which the volume thereof decreases, and the internal pressure thereof gradually increases. Where the rotor 4 rotates at high speed, the repeated increase and decrease in the internal pressurc applies a serious load to the pin 13 as back pressure with respect to the vanes 11*a*, 11*b* and 11*c*. In the worst case, the pin 13 becomes snapped.

Taking this into consideration, the Present pump is provided with tbe back pressure regulating groove 18 so that the internal pressure of the vane groove bottoms 12*a*40 , 12*b*40 and 12*c*40 may be regulated. The back pressure regulating groove 18 is annularly formed to be coaxial with the rotational shaft 10 in the inner surface of the end wall of the rear housing 2 as previously mentioned to communicate the vane groove bottoms 12*a*40 , 12*b*40 and 12*c*40 with one another. That is, paying attention to the fact that a period of increase and decrease in volumes of the vane groove bottoms 12*a*40 , 12*b*40 and 12*c*40 is deviated and the sum of the volumes of the three bottoms 12*a*40 , 12*b*40 and 12*c*40 is always approximately equal, the back pressure regulating groove 18 transfers a part of the pressure from the bottom 12*c*40 in the pressure increasing process to the bottom 12*b*40 in the pressure decreasing process to always balance the aforesaid pressure so as not to induce an excessive increase or decrease in pressure to the bottoms 12*a*40 , 12*b*40 and 12*c*40 .

Figure 6:
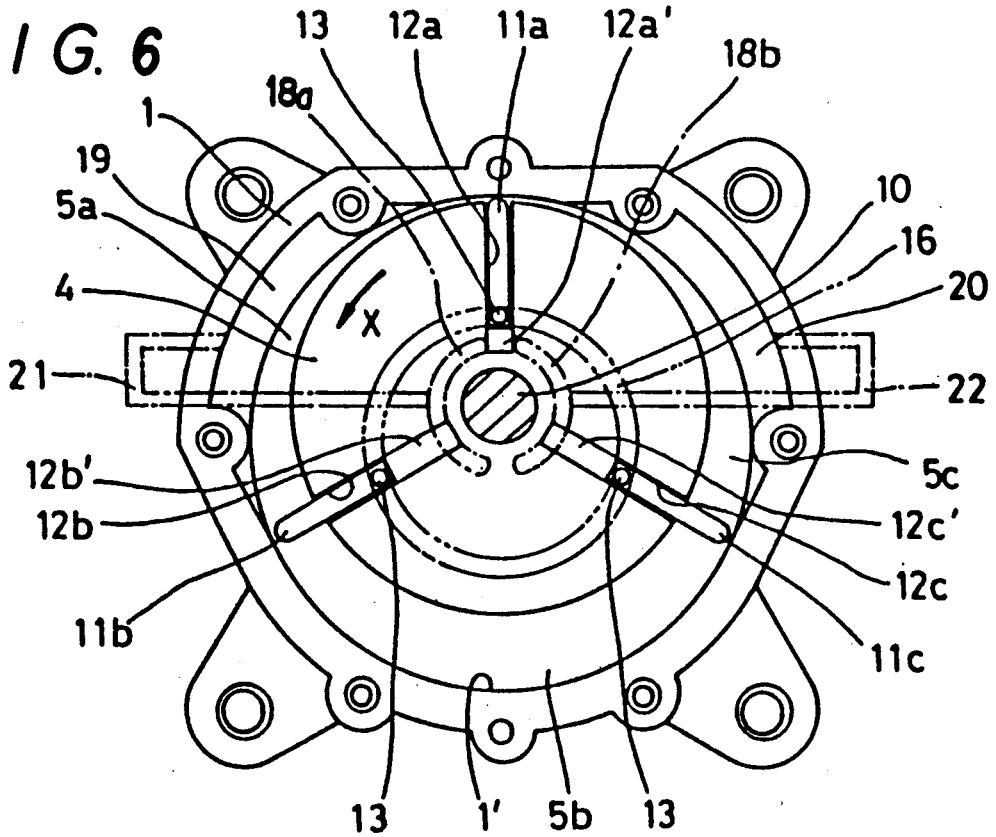
FIGS. 6 to 7 are repsectively explanatory views showing different modes of a back pressure regulating groove.
Figure 7:
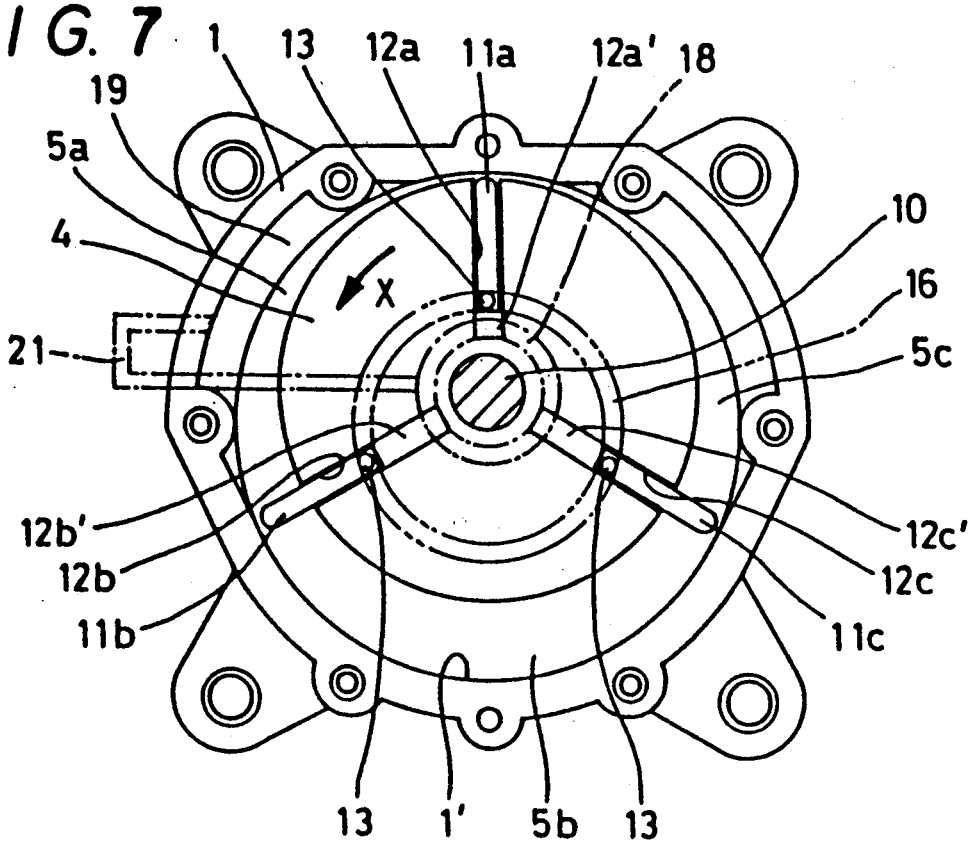
Figure 8:
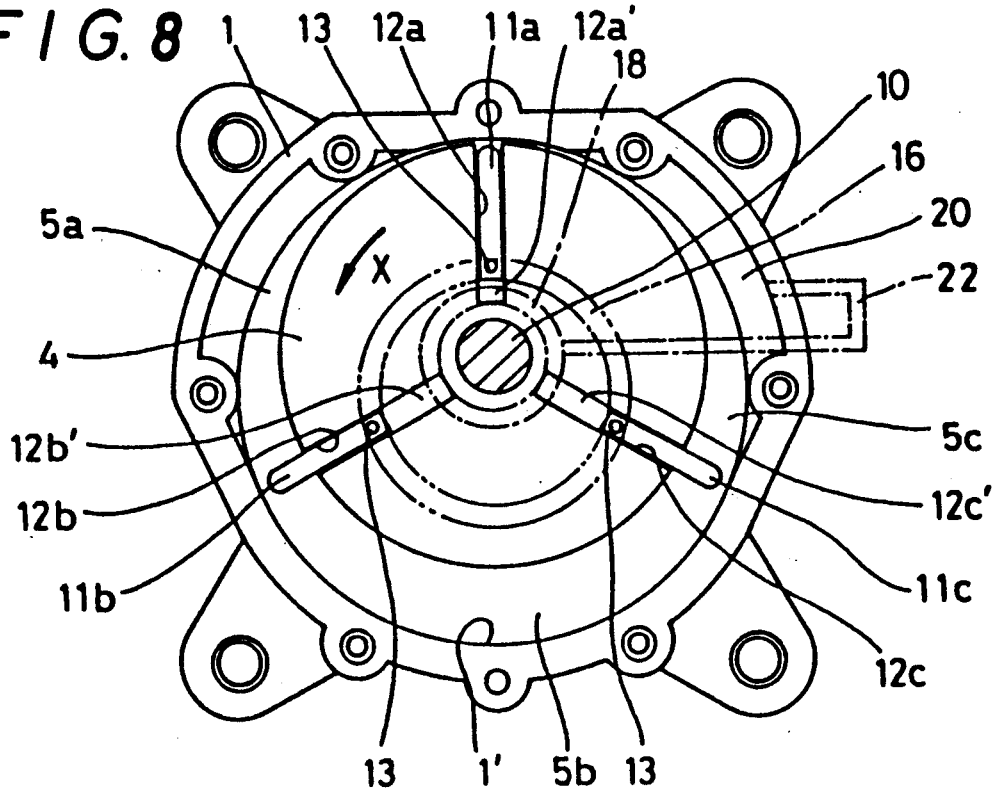

FIG. 6 shows an arrangement wherein the back pressure regulating groove 18 is divided into a pressure decreasing process portion 18*a* from the top position to the bottom position and a pressure increasing portion 18*b* from the bottom position to the top position. The former pressure decreasing process portion 18*a* and an inlet communication space 19, and the latter pressure increasing process portion 18*b* and an outlet communication space 20 are connected by pipes 21 and 22, respectively, whereby inside and outside of the vanes 11*a*, 11*b* and 11*c* (the vane groove bottoms and working spaces) are communicated to approximately balance the pressures between the inside and outside. FIG. 7 shows an arrangement wherein the annular back pressure regulating groove 18 and the inlet communication space 19 are connected through the pipe 21, and FIG. 8 shows an arrangement wherein the back pressure regulating groove 18 and the outlet communication space 20 are connected through the pipe 22, whereby the inside of the vanes 11*a*, 11*b* and 11*c* are roughly equalized in pressure with either the inlet communicating space 19 or the outlet communicating space 20 to relieve the load applied to the vanes.

Figure 9:
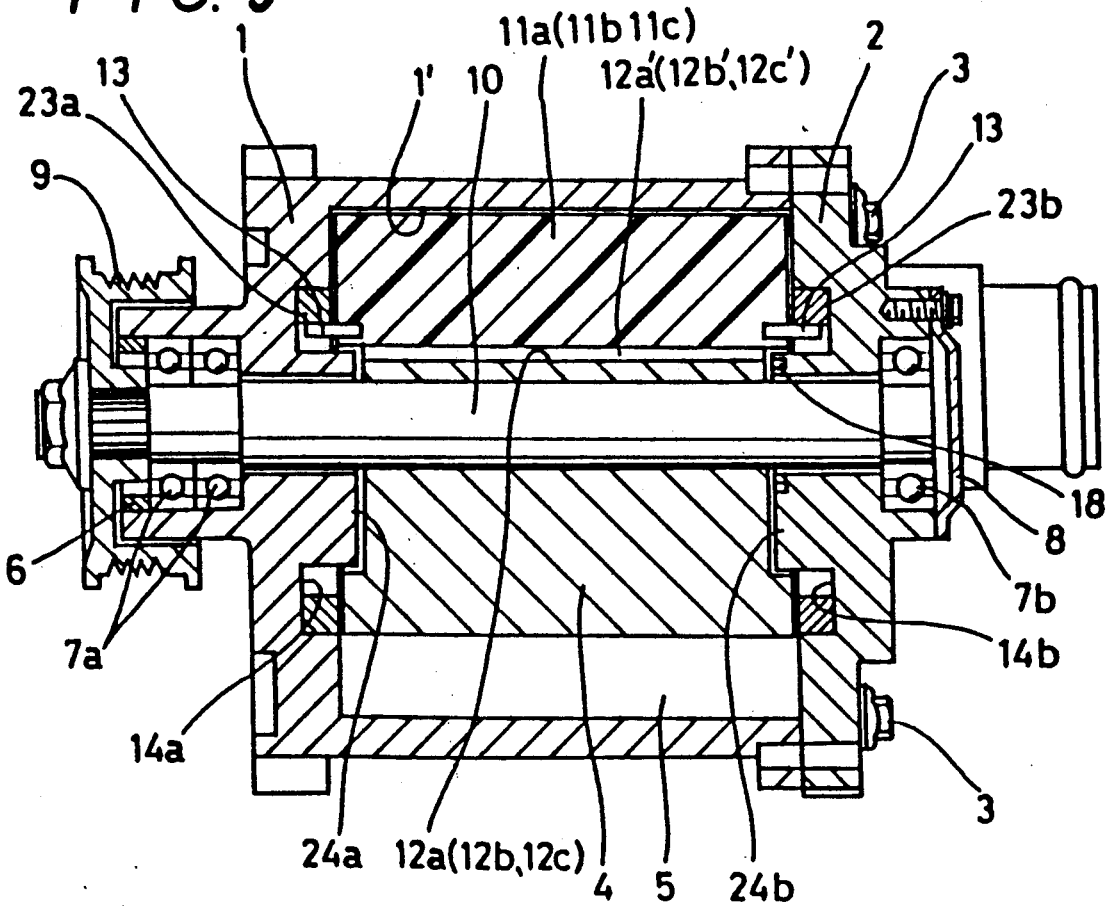
FIG. 9 is a sectional view of a vane pump according to a further embodiment of the present invention.

Next, a second embodimentof this aspect of the present invention will be described with regard to only parts different from those of the above-described first embodIment. As shown in FIG. 9, the vane pump is designed so that retainer rings 23*a* and 23*b* having a simple rectangular section in place of the retainer plates 15*a* and 15*b* having the annular race 16 in the first embodiment are fitted in annular recesses 14*a* and 14*b* in order to reduce trouble and cost required for manufacturing the retainer rings 23*a* and 23*b*. The pins 13 projected on the sides of the vanes 11*a*, 11*b* and 11*c* engage the inner peripheral surfaces of the retainer rings 23*a* and 23*b* to define the protrusion of the vanes from the vane grooves 12i a, 12*b* and 12*c* and are maintained in non-contact with the inner peripheral surface 140 of the housing 1. With this arrangement, the vanes 11*a*, 11*b* and 11c are freed in a direction in which they are retracted into the vane grooves 12a, 12b and 12c, and the vanes 11a, 11b and 11c are freely retracted when the pump stops or runs at a low speed, by which movement the vanes undergo an impact load and are possibly damaged early. Therefore, bosses 24a and 24b as stoppers are projected internally of the vanes 11a, 11b and 11c to define the free movement thereof. These bosses 24a and 24b in rhe form of an annulus are provided coaxial with the inner peripheral space 5 of the housing 1 and molded integral witb tbe end walls of the fronr housing 1 and rear housing 2. In the end surface of the boss 24b on the rear housing 2 side is formed one or more back pressure regulating grooves 18, having a construction as shown in the above-described embodiment of FIGS. 5 to 8. The retainer rings 23a and 23b may be replaced by ball bearings.

Figure 10:
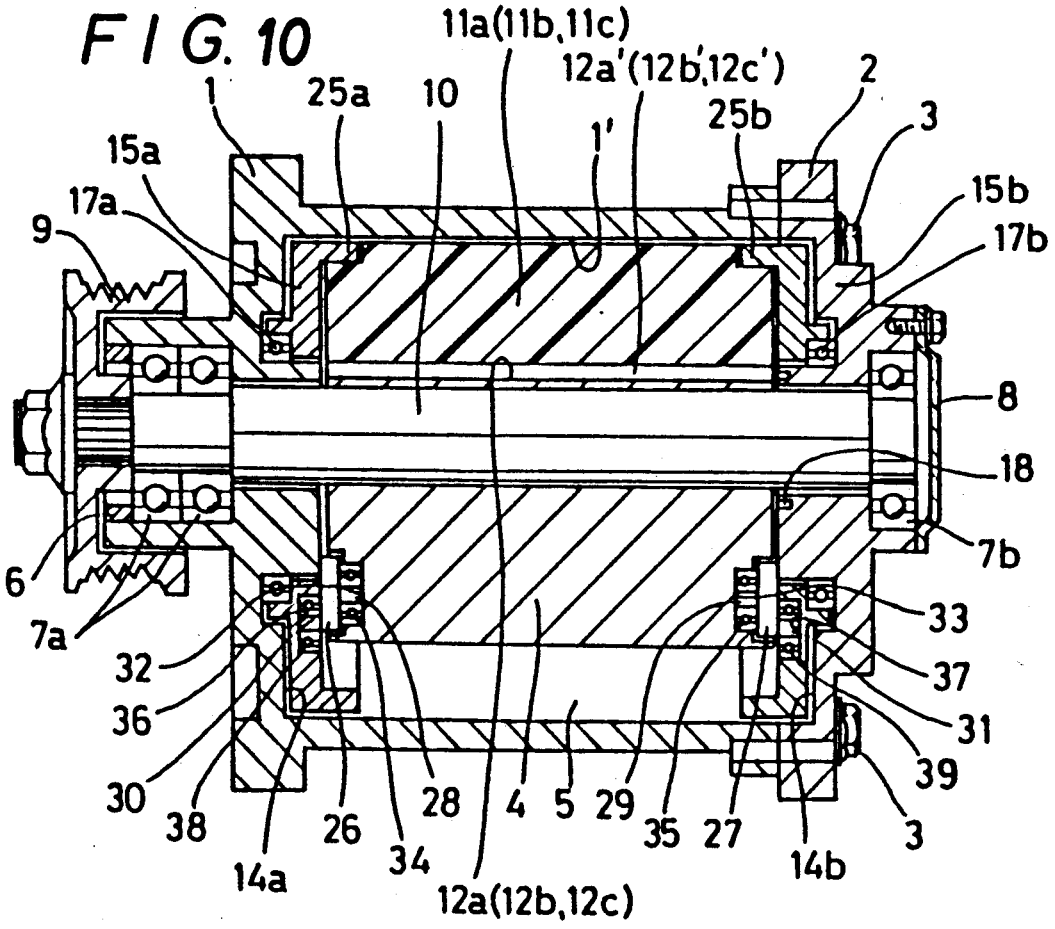
FIG. 10 is a sectional view of a vane pump according to still another embodiment of the present invention.
Figure 11:
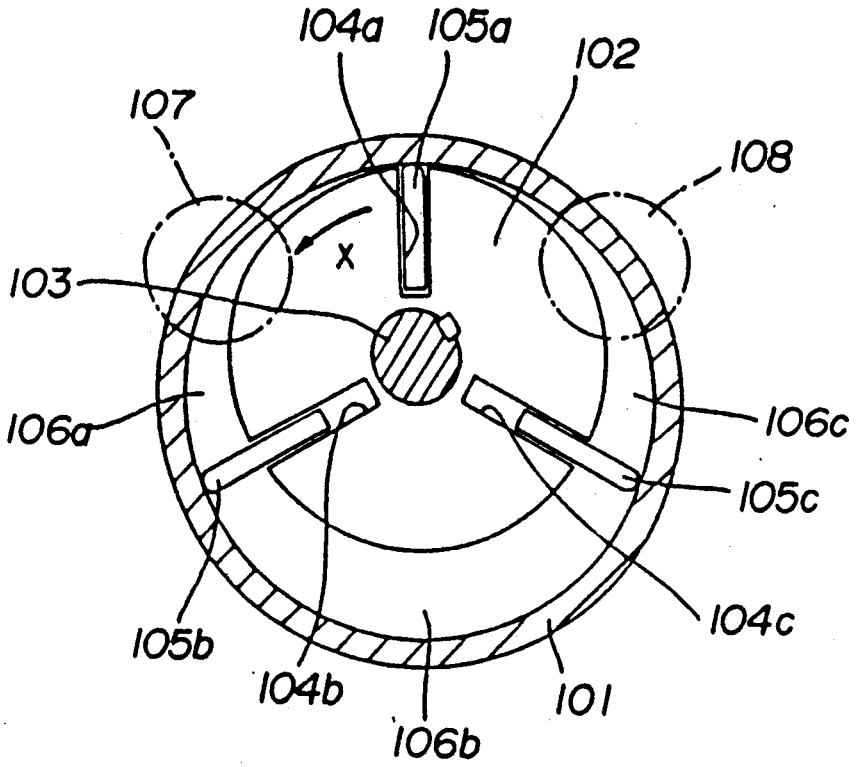
FIG. 11 PRIOR ART
FIG. 11 is a sectional view showing one example of vane pump according to the prior art.

FIG. 10 shows a third embodiment of this aspect of the present invention. Stoppers 25a and 25b projected parallel to the axis are formed on the outer peripheral ends of retainer plates 15a and 15b to define the protrusion of the vanes 11a, 11b and 11c. Reference numerals 26 and 27 designate cams for rotatively connecting the rotor 4 and the re(ainer plates 15a and 15b between the opposite ends tbereof, tbe cams being disposed three in number in equalIy spaced relation on one side of the rotor 4. The cams 26 and 27 fitted in recesses 32 and 33 formed in equally spaced relation on the end of the rotor 4 have first pins 28 and 29 extended to engage the rotor 4 at the center of one surface (inner surface) of a circular disk and are rotatably mounted on the rotor 4 through ball bearings 34 and 35. The cams further have second pins 30 and 31 extended to engage the retainer plates 15a and 15b in the vicinity of the peripheral edge of the other surface (outer surface) of the rotary disk and are rotatably engaged through ball bearings 38 and 39 with recesses 36 and 37 formed in the retainer plates 15a and 15b. The first pins 28 and 29 and the second pins 30 and 31 are on the circumferences of the same diameter eccentrically with each other through an eccentric amount of the rotor 4. and the retainer plates 15a and 15b are rotated in synchronism with the rotor 4 by the cams 26 and 27. This pump also defines the protrusion of the vanes 11a, 11b and 11c by the action of the stoppers 25a and 25b to maintain the vanes 11a, 11b and 11c not in contact with the housing 1. Further,the cams 26 and 27 are used to provide synchronous rotation between the rotor 4 and retainer plates 15a and 15b, thus making it possible to suppress the loss of torque resulting from the rotation to prevent inconveniences such as wear, generation of heat and the like. It is to be noted that in the pump, the cams 26 and 27 may be removed to simplify the construction, and in addition, the boss described in connection with the above-described second embodiment may be added, and means for defining the movement of the vanes 11a, 11b and 11c may be used.

As means for defining the amount of protrusion of the vanes 11a, 11b and 11c. it is contemplated that in addition to the above, the aforesaid cams 26 and 27 are used to engage the vanes 11a, 11b and 11c with the retainer plates 15a and 15b for connection therebetween. FIG. 10 shows the annular back pressure regulating groove 18 which operates in the same manner as the annular back pressure regulating groove 18 previously described and shown in FIG. 9.

While we have described the preferred embodiment of tbe present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. No. 075,006, filed July 17, 1987; U.S. Ser. No. 110,919 filed Oct. 21, 1987; U.S. Ser. No. 113,568 filed Oct. 26, 1987; and U.S. Ser. No. 115,677 filed Oct. 30, 1987.

What we claim is:

1. A rotary machine comprising a stationary housing means having a rotor chamber, said rotor chamber having an inner peripheral surface, a rotor means rotatably mounted in said rotor chamber, said rotor means having a rotor shaft having an axis of rotation, said inner peripheral surface having a central axis which is eccentrically disposed relative to the axis of rotation of said rotor means, said stationary housing means having generally planar inner end walls defining the longitudinal ends of said rotor chamber, each of said inner end walls having a cylindrical opening through which said rotor shaft extends, said rotor mean shaving longitudinal end walls juxtaposed to said inner end walls of said housing means, said rotor means having a plurality of generally radially disposed vane slots, a plurality of vane means slidably mounted in said vane slots and operable to define variable volume chambers as said rotor means rotates and said vane means move generally radially in and out of said vane slots, said vane means having longitudinal ends, projection means projecting from said longitudinal ends, said housing means having annular ring means disposed in said end walls of said housing means, said ring means being coaxial with said peripheral surface of said rotor chamber and being disposed to be engaged by said projection means to limit the extent of outward radial movement of said vane means to limit the extent of outward radial movement of said vane means from its respective vane slot to preclude sliding contact between said vane means and said inner peripheral surface of said housing means, and back pressure regulating means including annular groove means disposed in said end walls of said stationary housing means between said ring means and said cylindrical opening, said annular groove means having a central axis coincident with said axis of rotation of said rotor means, said annular groove means being juxtaposed to said vane slots and communicating with said vane slots for regulating the internal back pressure on said vane means in said vane slots.

2. A rotary machine according to claim 1, said annular ring means has an inside diameter annular surface and an outside diameter annular surface, said annular groove means being provided in said inner end wall of said housing means between said inside diameter annular surface of said annular ring means and said cylindrical opening.

3. A rotary machine according to claim 1, wherein each of said vane means has an inner longitudinal surface interconnecting said longitudinal ends of said vane means, said vane slots having a bottom wall, said annular groove means communicating with said vane slots for regulating the internal back pressure of said vane means between said inner longitudinal surfaces of said vane means and said bottom wall of said vane slots.

4. A rotary machine according to claim 3, wherein said housing means further includes an inlet communication space and an outlet communication space, said annular groove means of said back pressure regulating means further including a first groove and a second groove separate from said first groove, said back pressure regulating means having first conduit means interconnecting said inlet communication space and said first groove and second conduit means interconnecting said outlet communication space and said second groove for regulating the internal back pressure of said vane means in said vane slots.

5. A rotary machine according to claim 3, wherein said housing means further includes an inlet communication space, said back pressure regulating means having conduit means interconnecting said inlet communication space and said annular groove means to substantially equalize said internal back pressure acting on said vane means in said vane slots to the pressure of said inlet communication space.

6. A rotary machine according to claim 3, wherein said housing means further includes anoutlet communication space, said back pressure regulating means having conduit means interconnecting said outlet communication space and said annular groove means to substantially equalize said internal back pressure acting on said vane means in said vane slots to the pressure of said outlet communication space.

7. A rotary machine according to claim 3, wherein said planar inner end walls of said housing means includes an inner end walls section between said cylindrical opening in said housing means and said ring means.

* * * * *